United States Patent [19]

Danisch et al.

[11] Patent Number: 4,851,184

[45] Date of Patent: Jul. 25, 1989

[54] BUILDING MADE FROM CONCRETE WALLS, IN PARTICULAR FOR NUCLEAR PLANTS

[75] Inventors: Ruediger Danisch, Erlangen; Norbert Krutzik, Frankfurt am Main; Otto Schad, Seligenstadt; Wolfgang Zerna; Friedhelm Stangenberg, both of Bochum, all of Fed. Rep. of Germany

[73] Assignee: Siemens Aktiengesellschaft, Munich, Fed. Rep. of Germany

[21] Appl. No.: 188,274

[22] Filed: Apr. 29, 1988

[30] Foreign Application Priority Data

Apr. 29, 1987 [DE] Fed. Rep. of Germany ..... 3714354

[51] Int. Cl.[4] ..... G21D 1/00

[52] U.S. Cl. ..... 376/285; 376/293

[58] Field of Search ..... 52/169.6; 376/285, 293

[56] References Cited

U.S. PATENT DOCUMENTS

| | | | |
|---|---|---|---|
| 2,853,624 | 9/1958 | Wigner et al. | 376/293 |
| 3,022,238 | 2/1962 | Kolflat | 376/293 |
| 3,147,878 | 9/1964 | Wissmiller | 376/293 |
| 3,438,857 | 4/1969 | Sulzer | 376/293 |
| 3,458,052 | 7/1969 | Kann | 248/245 |
| 3,725,198 | 4/1973 | Harstead et al. | 376/293 |
| 4,032,397 | 6/1977 | Beine et al. | 376/293 |
| 4,213,824 | 7/1980 | Jabsen | 376/293 |
| 4,277,309 | 7/1981 | Schabert | 376/293 |
| 4,297,167 | 10/1981 | Schabert | 376/293 |

FOREIGN PATENT DOCUMENTS

| | | | |
|---|---|---|---|
| 0009654 | 4/1980 | European Pat. Off. . | |
| 1052095 | 3/1959 | Fed. Rep. of Germany . | |
| 1299404 | 7/1969 | Fed. Rep. of Germany . | |
| 905834 | 12/1945 | France | 52/169.6 |
| 411494 | 8/1945 | Italy | 52/169.2 |

*Primary Examiner*—Deborah L. Kyle
*Assistant Examiner*—Richard W. Wendtland
*Attorney, Agent, or Firm*—Herbert L. Lerner; Laurence A. Greenberg

[57] ABSTRACT

A building, especially a nuclear plant, includes concrete walls enclosing components such as plant components as a protection against external action. The concrete walls have exposed locations, and the concrete walls have double-layered regions at the exposed locations with double layers defining hollow spaces therebetween. A damping material may fill the hollow space.

8 Claims, 4 Drawing Sheets

BUILDING MADE FROM CONCRETE WALLS, IN PARTICULAR FOR NUCLEAR PLANTS

The invention relates to a building made from concrete walls, in particular for nuclear plants, which encloses plant components in order to protect them from external influences.

The concrete walls are typically made of steel-reinforced concrete and are constructed, at least in the regions that perform the protection functions, in such way that they can withstand the outside influences for which they are designed, such as the impact of an airplane crashing into them. A so-called secondary shielding of a nuclear power plant, for instance, is constructed for this purpose in the form of a concrete containment which is up to 2 meters thick. Naturally, the concrete is reinforced.

German Published, Prosecuted Applications DE-AS Nos. 10 52 095 and 12 99 404 as well as European Pat. No. 0 009 654 disclose buildings which are constructed differently and are not able to enclose comparably large components in such a manner as to protect them from destruction.

It is accordingly an object of the invention to provide a building made from concrete walls, in particular for nuclear plants, which overcomes the hereinafore-mentioned disadvantages of the heretofore-known devices of this general type and which minimizes the concussions that are to be expected in the case of a pulsed load (with a special case being an aircraft impact). As a consequence, greater safety of the components and systems from external influences is to be obtained at comparable expense.

With the foregoing and other objects in view there is provided, in accordance with the invention, a building, especially a nuclear plant, comprising concrete walls enclosing components, such as plant components as a protection against external action, the concrete walls having exposed locations and the concrete walls having double-layered regions at the exposed locations with double layers defining hollow spaces therebetween, being optionally filled with a damping material. The hollow spaces can also be provided with an additional thin-walled linings.

In accordance with again another feature of the invention, the double layers of the prefabricated building elements include outer shells having shapes and dimensions forming means for highly plastically deforming the outer shells with energy dissipation upon the occurrence of local pulsed loads.

According to the invention, external action is no longer absorbed rigidly but instead is absorbed resiliently at exposed points, with an intentional plasticizing and with the maximum possible dissipation of energy. In this way the used load to be absorbed is distributed over time, so that impact strains lessen the forces locally induced into the structure. This is also the prerequisite for reducing the loads on the components housed in the building by means of induced forces of acceleration, both in terms of static safety and in terms of the strains to be expected The invention is thus distinguished from the prior art described in German Published, Prosecuted Applications DE-AS Nos. 10 52 095 and 12 99 404 as well as European Pat. No. 0 009 654, in which buildings are constructed differently and are not in a position to enclose comparably large components in such a manner as to protect them from destruction.

With the invention, it also becomes less necessary to provide cost-intensive proof of functional conditions of components and buildings strained by shock-induced concussions. This is particularly true for all of the electrical wiring and plumbing components. Until now, the ability of these systems to function was documented for a frequency range of up to approximately 35 Hz, like that to be expected in earthquakes, for example. The requirement now being made for documenting functional ability even at high acceleration values, in the frequency range up to 80 Hz, which appears possible particularly in the case of aircraft impact, is largely obviated by the invention, because of the aforementioned reduction of accelerations.

In accordance with another feature of the invention, there are provided other wall regions neighboring the double-layered regions, the double-layered regions having outer surfaces protruding beyond the other wall regions. This enables a more comprehensive protection. This construction also makes it possible to keep the same interior capacity of the buildings, despite their double-layered structure, which is therefore thicker, at some points.

In accordance with a further feature of the invention, the double-layered regions are in the form of rounded regions at edges and corners of the building. This makes it possible to round the corners there so that the load-bearing capability of the shells can be exploited to improve energy distribution.

In accordance with an added feature of the invention, the double-layered regions are disposed in the vicinity of load-bearing ceilings located within the building. In this way, the aforementioned induction of forces brought to bear from the outside into the interior of the buildings is prevented in a particularly favorable manner.

In accordance with an additional feature of the invention, the double layers include an outer shell formed of concrete having a filamentary filler material. The outer layer of the double-layered wall regions can also be steel-fiber-reinforced concrete with corresponding armoring. A tough, energy-dissipating, resilient structure can thus be attained, which makes it possible to fully exploit both the plastic behavior of the steel-fiber-reinforced concrete as well as the damping effect of the lined hollow space.

In accordance with yet another feature of the invention, the double layers are in the form of shells, and each of the hollow spaces has a width substantially equal to the thickness of one of the plasticizing shells. On the other hand, the thickness can also be optimized and determined by the filling material.

In accordance with a concomitant feature of the invention, each of the double-layered wall regions is in the form of a prefabricated building element fastened to the outside of one of the concrete walls. This is an embodiment that is especially promising economically, and is also suitable for retrofitting. In this connection, the term "fastened" means that in normal operation the prefabricated building elements exhibit the necessary static safety. This can be provided intrinsically by the weight with which the wall elements rest on the top of a concrete wall.

Other features which are considered as characteristic for the invention are set forth in the appended claims.

Although the invention is illustrated and described herein as embodied in a building made from concrete walls, in particular for nuclear plants, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
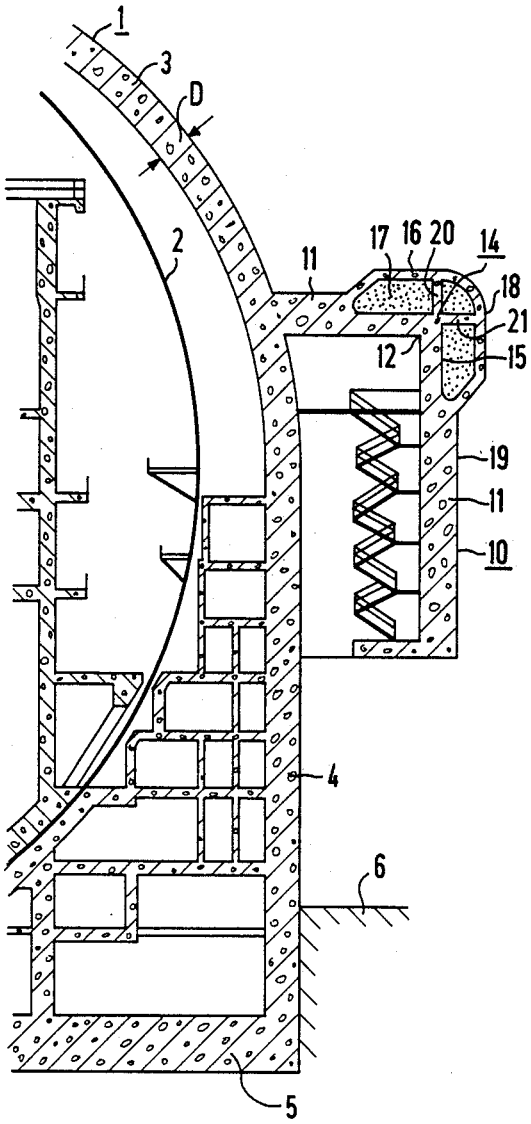
FIG. 1 is a fragmentary, diagrammatic, longitudinal-sectional view of the reactor building of a pressurized water reactor having a double-layered construction of the concrete wall provided on one corner.

Referring now to the figures of the drawings in detail and first, particularly, to FIG. 1 thereof, there is seen a reactor building 1 of a pressurized water reactor including a steel safety containment 2, which is a so-called secondary shielding in the form of a sphere having a diameter of 50 meters, for example. The upper portion of the sphere 2 is enclosed by a hemispherical roof portion 3 of the reactor building 1. Below the equator of the sphere, the reactor building is in the form of a vertical cylinder 4 extending to a base plate 5 of the reactor building, which is sunk into soil 6. In a construction which is in the form of heavily reinforced concrete, the thickness D of the reactor building wall 3, 4 is 2 meters, for example. This assures that aircraft striking the reactor building 1 will be unable to do serious damage, which could lead to rupturing of the safety containment 2 enclosing the radioactive components.

A so-called valve room or fixture chamber 10, which includes valves or fixtures for shutting off fresh-steam lines leading out of the safety containment 2, is connected to the outside wall 4 of the reactor building 1. Since these valves or fixtures have to be protected from destruction, walls 11 of the valve room or fixture chamber 10 which, for instance, are of block-like form, are at least as thick as those of the reactor building 1. In a typical rectangular building, for example, the emergency supply or feed building of a reactor plant has edges and corners, like those of the valve room or fixture chamber, which represent exposed regions in case of impact.

The upper outer corner 12 of the valve room or fixture chamber 10 is double-layered in a region 14, according to the invention. An outer shell 16 extends parallel to an inner shell 15, which has a shape approximately equivalent to that of the original wall 11 and has half the wall thickness thereof, the shells being spaced apart by the thickness of the shell or layer 15, forming a hollow space 17. The outer shell 16 is formed of concrete reinforced with steel fibers or filaments and is thus virtually homogeneously resilient. As FIG. 1 clearly shows, the outer surface 18 of the shell 16 protrudes beyond the surface or plane 19 of the wall 11 by approximately one-half of the original wall thickness, or in other words one meter beyond the plane 19 of the wall 11.

The hollow space 17 has three parts due to the fact that it is subdivided by two supports 20 and 21. Rigid expanded plastic in the form of a filler material having a damping action, is accommodated in the hollow space 17. The result of this structure is that if loads are brought to bear on the exposed wall region of the corner 12 from the outside, forces can be transmitted into the valve room or fixture chamber 10 and from it into the reactor building 1 only after attenuation.

Figure 2:
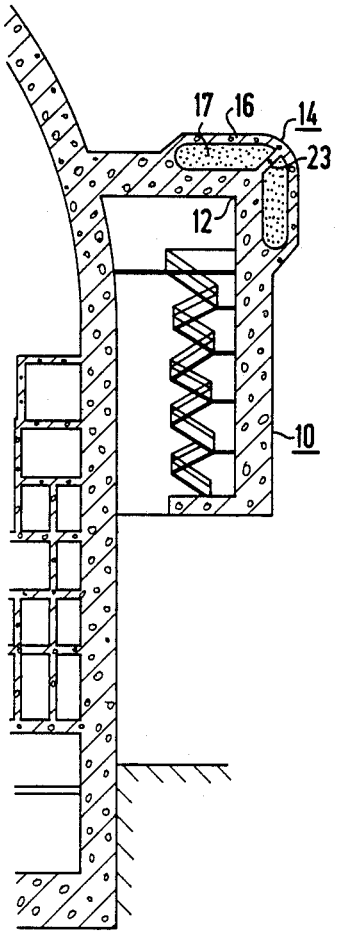
FIG. 2 is a view similar to FIG. 1 showing a modified double-layered construction of the same corner.

In the embodiment of FIG. 2, the corner 12 is again provided with a double-layered wall region 14. However, the outer shell 16 in this embodiment is only supported by a single support 23, resulting in a hollow space 17 having two chambers. The hollow space 17 contains metal mesh bodies acting as the damping filler material However, the chambers in the hollow space 17 can also be in the form of prefabricated thin-walled molded articles, without being filled with damping material.

Figure 3:
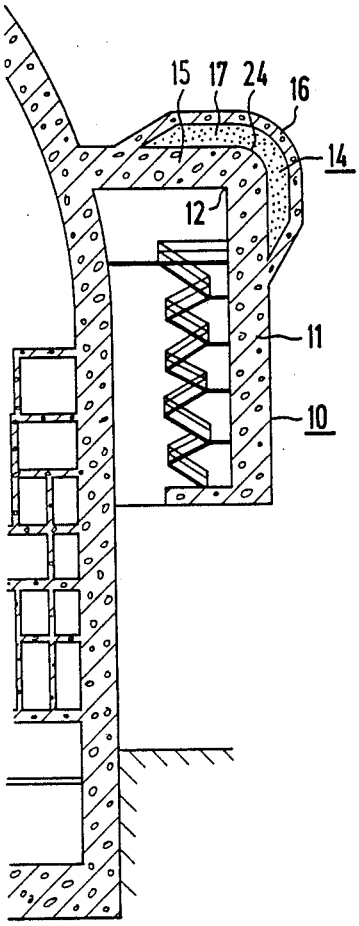
FIG. 3 is a view similar to FIGS. 1 and 2 showing still another construction of the corners.

As shown in FIG. 3, at the corner 12 of the valve room or fixture chamber 10, the inner shell 15 of the double-layered wall region 14 has practically the same wall thickness as the wall 11, although it has an outer rounded portion 24. The outer shell 16 is raised beyond the outer rounded portion 24, although without an internal support, resulting in a single-chambered intermediate space 17.

Figure 4:
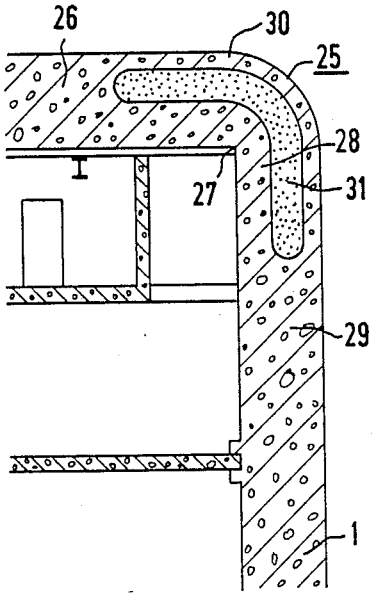
FIG. 4 is a fragmentary, longitudinal-sectional view of an integrated double-layered construction of the concrete wall in the vicinity of the roof of the reactor building.

In the embodiment illustrated in FIG. 4, the reactor building 1 is double-layered in a region 25 of a roof 26, which forms a corner 27. In this embodiment, an inner shell 28 of the double-layered region 25 is reduced to one-half the original thickness of solid walls 29. An outer shell 30 has a rounded portion parallel to the inner shell 28 which is in alignment with the outside of the walls 29. A hollow space 31 is again filled with damping material. Despite the "weakening" of the wall in the region 25 , sufficient resistance to penetration from the outside is obtained. In addition, external forces that are capable of engaging the exposed corner 27 are diminished, so that only slight acceleration forces are triggered in the interior of the reactor building 1.

Figure 5:
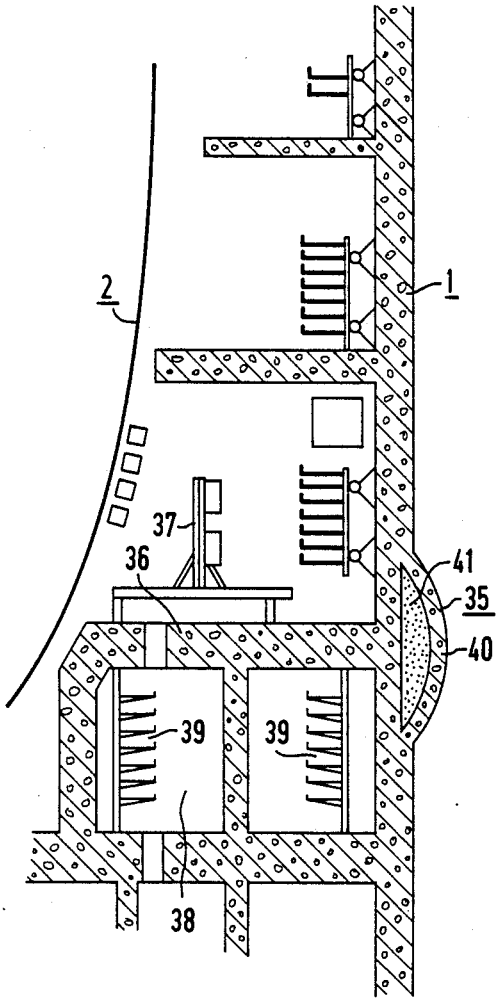
FIG. 5 is a fragmentary, longitudinal-sectional view of a reactor building showing the double-layered construction of the concrete wall in the vicinity of a load-bearing ceiling located in the interior of the building.

In the embodiment illustrated in FIG. 5, a region 35 of the reactor building 1 is shown at the level of an internal ceiling 36, on which components 37 are supported. For instance, the ceiling 36 encloses a room 38 having electrical systems, represented by cable lines 39. An outer shell 40 of the double-layered region 35 is rounded in shape, so that it protrudes convexly beyond the surface of the reactor building 1. Once again, the intermediate space 41 contains a filler material.

Figure 6:
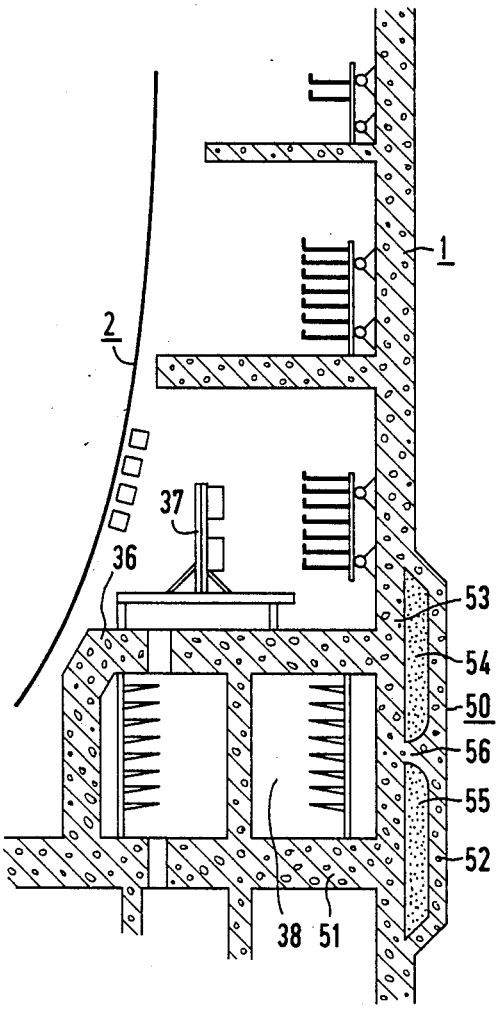
FIG. 6 is a view similar to FIG. 5 showing a double-layered construction of the concrete wall of the reactor building that extends over two ceilings located in the interior of the building.

FIG. 6 shows that the reactor building 1 can also be double-layered over a greater height in a region 50 in the vicinity of the ceiling 36. As a result, both the ceiling 36 as well a ceiling 51 located below it are protected. An outer shell 52 of fiber-reinforced concrete, together with an inner shell 53 of steel-reinforced concrete, contain two hollow spaces 54 and 55 bordering on one another and containing a damping material. A support 56 located between the hollow spaces 54 and 55 is dimensioned in such a way that no significant forces can be transmitted if there is a direct action from outside, because the inner shell 53 has the greater resiliency when the load is imposed.

Figure 7:
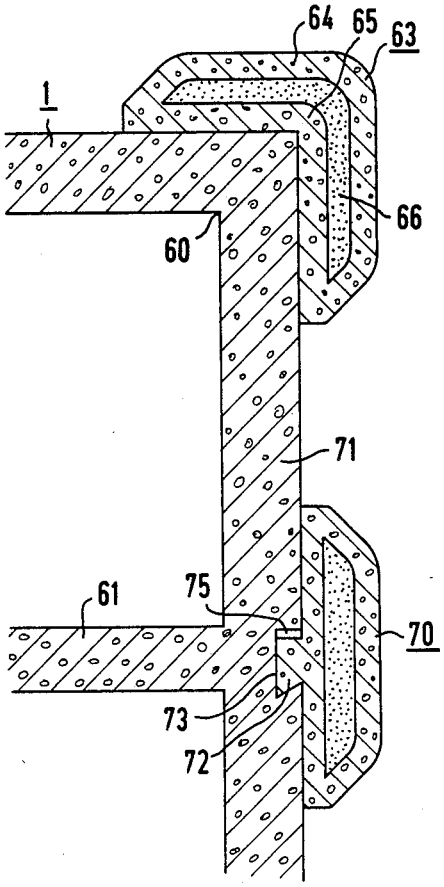
FIG. 7 is another fragmentary, longitudinal-sectional view showing the use of prefabricated building elements for practicing the invention.

In the embodiment illustrated in FIG. 7, the reactor building 1 is protected in the vicinity of a corner 60 and a load-bearing ceiling 61 located below it, by prefabricated building elements. A building element 63 associated with the corner 60 has a structure with a rectangular cross section adapted to the corner.

Two layers or shells 64 and 65 are both formed of steel fiber-reinforced concrete that is very tough. A hollow space 66 therebetween contains a filler material. The building element 63 is seated sufficiently firmly on the reactor building 1 merely by virtue of its own weight. At that location the building element 63 forms a damping protective layer, which prevents impact strains from being induced into the building 1 upon external action exerted upon the exposed point.

A building element 70 associated with the ceiling 61 covers the attachment of the ceiling 61 to a vertical concrete wall 71. The building element is engaged in a corresponding recess 73 with a dovetail-like protrusion 72 at the ceiling 61. A gap 75 remaining after the insertion can be filled up in order to increase strength and to attain a form-locking connection of the building element 70. A form-locking connection is one which is connects two elements together due to the shape of the elements themselves, as opposed to a force-locking connection, which locks the elements together by force external to the elements. However, other fastenings of the building elements 63, 70 to the reactor building 1 are also conceivable.

We claim:

1. Building for a nuclear plant, comprising concrete walls enclosing plant components as a protection against external action, said concrete walls having exposed locations, and said concrete walls having double-layered regions at said exposed locations with inner and outer layers defining hollow spaces therebetween, said outer layer having rounded corners and edges, and a solid damping material filling said hollow spaces.

2. Building according to claim 1, including other wall regions neighboring said double-layered regions, said double-layered regions having outer surfaces protruding beyond said other wall regions.

3. Building according to claim 1, wherein said double-layered regions are disposed in the vicinity of load-bearing ceilings located within the building.

4. Building according to claim 1, wherein said double layers include an outer shell formed of concrete having a filamentary filler material.

5. Building according to claim 1, wherein said double layers are in the form of shells, and each of said hollow spaces has a width substantially equal to the thickness of one of said shells.

6. Building according to claim 1, wherein each of said double-layered wall regions is in the form of a prefabricated building element fastened to the outside of one of said concrete walls.

7. Building according to claim 1, wherein said solid damping material is in the form of metal mesh bodies.

8. Building according to claim 1, wherein said solid damping material is in the form of rigid expanded plastic.

* * * * *